US006608591B2

(12) United States Patent
Wästberg

(10) Patent No.: US 6,608,591 B2
(45) Date of Patent: Aug. 19, 2003

(54) DUAL-BEAM ANTENNA APERTURE

(75) Inventor: Bo Gunnar Wästberg, Västra Frölunda (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/993,136

(22) Filed: Nov. 14, 2001

(65) Prior Publication Data

US 2002/0080073 A1 Jun. 27, 2002

(30) Foreign Application Priority Data

Nov. 14, 2000 (SE) ..... 0004165

(51) Int. Cl.[7] ..... H01Q 3/26
(52) U.S. Cl. ..... 342/373
(58) Field of Search ..... 342/373

(56) References Cited

U.S. PATENT DOCUMENTS 5,686,926 A 11/1997 Kijima et al.
6,094,165 A * 7/2000 Smith ..... 342/373

FOREIGN PATENT DOCUMENTS

DE 198 45 868 A1 4/2000
EP 0 642 192 A1 3/1995
WO 99/17403 A1 4/1999

* cited by examiner

*Primary Examiner*—Thomas H. Tarcza
*Assistant Examiner*—Fred H. Mull

(57) ABSTRACT

An improved antenna arrangement for base stations in communication networks is disclosed. The arrangement has panel apertures generating a multi-beam pattern while producing acceptable side-lobe levels. A typical arrangement includes a plurality of radiator elements arranged in three separate vertical columns along the antenna panels thereby forming the radiation aperture. A number of such panels may form a base station antenna, where each aperture produces two beams. Each group of three columns may be further divided into sub-panels for providing different elevation patterns. Feeding signals for the two lobes from each group of columns are connected to an elevation beam-forming network and to an azimuth beam-forming network having three output terminals forming antenna ports. The beam-forming network generally creates a 90° phase-gradient between the signals appearing at the antenna ports. The angle may also be arbitrary. The three separate columns are typically vertically polarized. The aperture-coupled radiator elements may include patch antenna elements, which are separately fed by a strip-line network.

22 Claims, 11 Drawing Sheets

Table I

| Beam | Terminal $A_1$ | Terminal $A_2$ | Terminal $A_3$ |
|---|---|---|---|
| beam 1 | 0.5∠0° | 0.707∠-90° | 0.5∠-180° |
| beam 2 | 0.5∠-180° | 0.707∠-90° | 0.5∠0° |

Fig. 19

Table II

| Beam | Phase-shifter | Terminal $A_1$ | Terminal $A_2$ | Terminal $A_3$ |
|---|---|---|---|---|
| beam 1 | 90° | 0.5∠0° | 0.707∠-90° | 0.5∠-180° |
| beam 2 | 90° | 0.5∠-180° | 0.707∠-90° | 0.5∠0° |
| beam 1 | 80° | 0.502∠0° | 0.704∠-85° | 0.502∠-170° |
| beam 2 | 80° | 0.502∠-170° | 0.704∠-85° | 0.502∠0° |
| beam 1 | 70° | 0.508∠0° | 0.696∠-80° | 0.508∠-160° |
| beam 2 | 70° | 0.508∠-160° | 0.696∠-80° | 0.508∠0° |
| beam 1 | 60° | 0.517∠0° | 0.683∠-75° | 0.517∠-150° |
| beam 2 | 60° | 0.517∠-150° | 0.683∠-75° | 0.517∠0° |

Fig. 20

Table III

| | Measured parameter | | Desired parameters | |
|---|---|---|---|---|
| | Scan angle [°] | Beam-width [°] | Scan angle [°] | Beam-width [°] |
| Network I (90° phase-gradient angle) | 37 | 55 | 30 | <60 |
| Network II (arbitrary phase-gradient angle, $\phi$=65°) | 29 | 53 | | |

Fig. 21

DUAL-BEAM ANTENNA APERTURE

BACKGROUND

The present invention relates to phased antenna arrays and more particularly to multi-lobe antennas particularly for base stations in communication networks.

Base station antennas generally consist of a vertically oriented linear array of antenna elements for achieving a narrow beam in elevation and a wide lobe in azimuth, providing a sufficient gain and coverage of the cell. The operator is usually demanding as small antenna units as possible due to environmental restrictions. In the perspective of the operator it is also advantageous to reduce the number of antenna units needed at a site, for example by including two or more frequency bands in one unit, i.e. co-siting, or by including more than one beam in the antenna unit. Another demand would be a base-station antenna aperture providing two beams pointing in different directions.

Prior art utilizes different approaches to solve the problem, for instance using aperture-coupled micro-strip antennas, antenna arrays and hybrid junctions.

For instance U.S. Pat. No. 5,686,926 discloses a multi-beam antenna device. Two beams with equiangular spacing are formed at a single antenna face. Multiple beams are generated by combining a plurality of such faces. The solution makes it possible to reduce the size of an antenna device and to decrease the wind load sustained by the antenna, whereby it becomes possible to mount many antennas onto a single supporting structure and to achieve substantial weight reduction of a supporting structure. However, it is apparent that a multi-beam antenna consisting of a two-element array, i.e. two vertical columns of antenna elements, where each antenna element or column is connected to a hybrid junction will not provide sufficiently good performance suitable for base station applications. A two-element array may provide the desired ±30° pointing directions and a 3 dB beam-width of about 60°, but will not give sufficiently good side-lobe suppression. Simulated azimuth antenna diagrams for a two-element array at a frequency of 2045 MHz are shown in FIG. 2. The geometry of the two-element array is shown in FIG. 3. The first side-lobe of the right and left beams has its peak well above −15 dB and a substantial part of the power will therefore radiate into adjacent cells.

Still there is a demand for an antenna arrangement providing a compact multiple beam antenna device offering low side-lobe levels and using a reduced number of necessary panels for a base station facility with the full desired area coverage.

SUMMARY

An antenna arrangement and an antenna system are disclosed. The inventive antenna provides an aperture generating a multi-beam pattern producing lower side-lobe levels for a base station in a communications network compared to the state of the art. The arrangement and system consist of a plurality of radiators arranged in three vertical columns of radiating elements along an antenna panel forming an aperture. A number of such panels together will form a base station antenna, where each such aperture produces two beams. Each group of three columns is further divided into sub-units for providing different elevation coverage, and each sub-unit of three separate columns is then connected to a separate beam-forming network having three output terminals forming antenna ports and two input terminals. In an orthogonal embodiment the beam-forming network generally creates a 90° phase-gradient between the signals appearing at the antenna ports. The three radiator columns are vertically polarized and consist of the order of 2 to 8 sub-units in the elevation direction and each of the three columns contains at least three aperture-coupled radiator elements. These aperture-coupled radiator elements generally consist of patch antenna elements for instance separately fed by a strip-line network. The beam-forming networks may either be supporting a 90° phase-gradient angle or may be supporting arbitrary angles.

BRIEF DESCRIPTION OF THE DRAWINGS

The invention, together with further objects and advantages thereof, may best be understood by making reference to the following description taken together with the accompanying drawings, in which:

FIG. 19 shows a Table I presenting excitations and phase angles of the azimuth beam-forming network with fixed scanning angle;

FIG. 20 shows a Table II presenting excitations and phase angles of the azimuth beam-forming with adjustable scanning angle; and FIG. 21 shows a Table III presenting measured parameters for an antenna section with azimuth beam-forming network with fixed scanning angle as well as for an azimuth beam-forming network with adjustable scanning angle.

DETAILED DESCRIPTION

Figure 5:
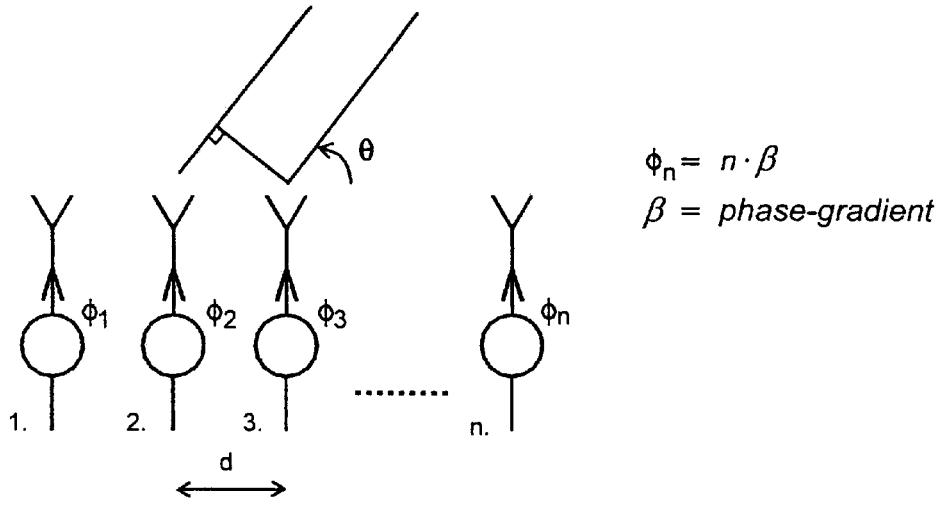
FIG. 5 illustrates the basic principle of a phased array.

A multi-lobe antenna can be implemented as a phased array antenna. At least two elements are needed for achieving any kind of phase steering of the beam(s). The principle of a phased array is shown in FIG. 5. The amplitude of an N element phased array is given by $$\overline{E}(\theta) = \overline{E}_0(\theta) \cdot \sum_{n=1}^{N} e^{jn(\beta + kd \cdot \cos\theta)} \quad \text{(EQ1)}$$

where $\overline{E}_0(\theta)$ is the element factor, the phase-gradient is given by $\beta$, the spacing of the linear array is given by d and k is the wave number. A maximum will occur for the angle $\theta_0$ when $$\beta + kd \cdot \cos\theta_0 = 0 \quad \text{(EQ2)}$$

which is the definition of the scan angle.

For an ideal phased array the scan angle can be adjusted to a desired value by varying the phase-gradient $\beta$ and the spacing d between the elements. The beam-width is a function of the element factor and the number of elements N in the array as well as the spacing d. For practical applications there will be coupling between the antenna elements that cannot be ignored, which will alter the beam-width and the scan angle. The spacing d should be kept sufficiently small, $d/\lambda<1$, otherwise there will be grating lobes in the "visible" space.

Figure 4:
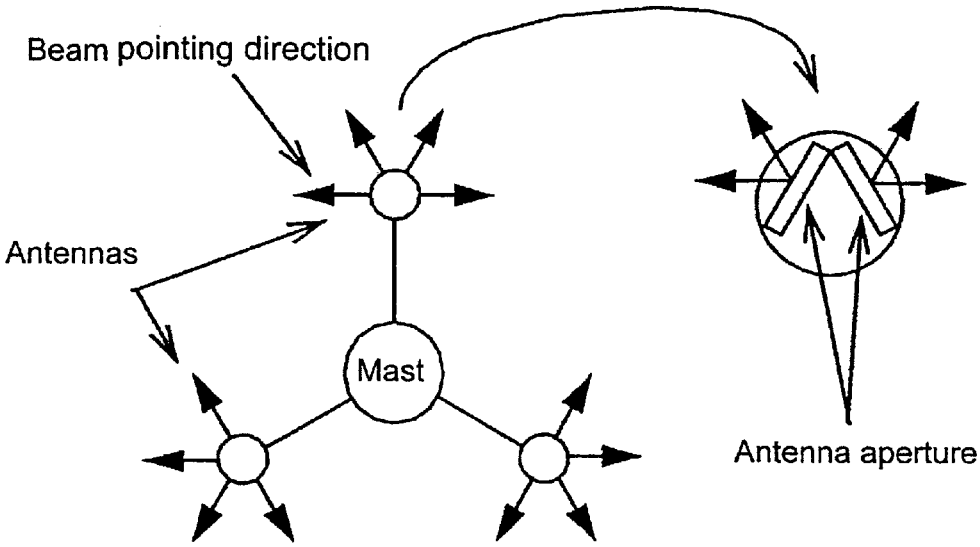
FIG. 4 is an example of a 6-sector antenna installation with space diversity and double 60° dual beam antennas pointing 60° apart, each of the three groups then covering 240° in azimuth.
Figure 6:
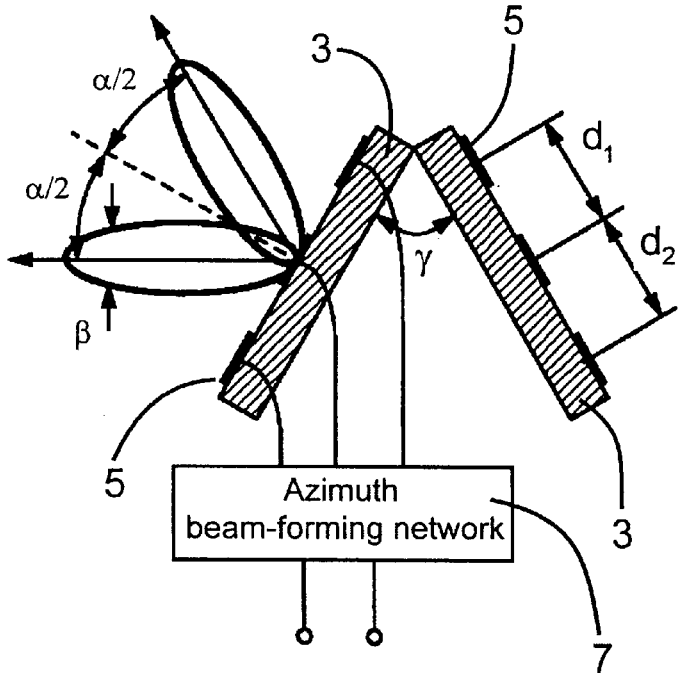
FIG. 6 illustrates in an enlarged view two panels with three columns of radiator elements each panel having two lobes as indicated in FIG. 4.

The number of antenna units needed for the particular site could be reduced by using the suggested invention. We now refer to FIG. 4. The installation is then carried out by three quad-beam antenna units based on a similar arrangement as in FIG. 1. Each quad-beam unit consists of two apertures positioned in a 60° angle ($\lambda$) with respect to each other. According to the present improved case each panel provides three columns of radiating elements forming the aperture of the antenna panel 3 (FIG. 6), which provides two beams of approximately 60° pointing about ±30° off the aperture normal but with a lower side-lobe levels than in similar structures according to the state of the art, e.g. as demonstrated in U.S. Pat. No. 5,686,926. To operate the presently suggested new configuration an azimuth beam-forming network having two input terminals and three output terminals will be needed for each panel aperture or sub-unit. FIG. 6 illustrates in more detail two panels each having two lobes as indicated in FIG. 4. The scan angle is $\pm\alpha/2°$ and the width of each lobe is $\beta$. The distance between adjacent antenna radiator elements (e.g. patches) is $d=d_1=d_2$. Preferably the distances should be equal but may also in principle be chosen different.

Figure 1:
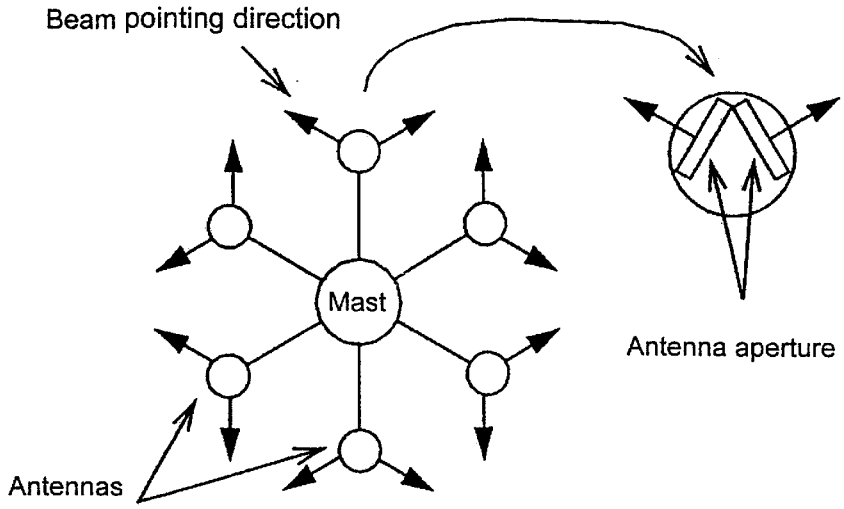
PRIOR ART Fig. 1
FIG. 1 is an example of a 6-sector antenna installation with space diversity and 60° dual beam antennas pointing 120° apart according to the state of the art.

The suggested invention is a way of both reducing the number of needed antennas at a site as well as improving level of generated side-lobes. An example of a site installation according to the state of the art is shown in FIG. 1. The 6-sector site with space diversity is built by using 6 dual-beam antenna units with 2×60° beam-width each providing a total number of 12 beams. Each antenna unit consists of two panel apertures and positioned in a 60° angle with respect to each other. Two such apertures are integrated in one antenna unit and positioned to give beams directed +60° and −60°.

Figure 7:
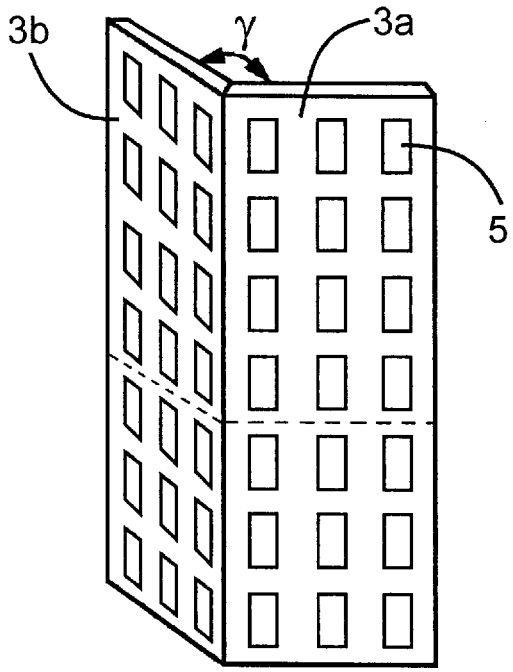
FIG. 7 illustrates a side view of the two dual-beam apertures according to FIG. 6.
Figure 8:
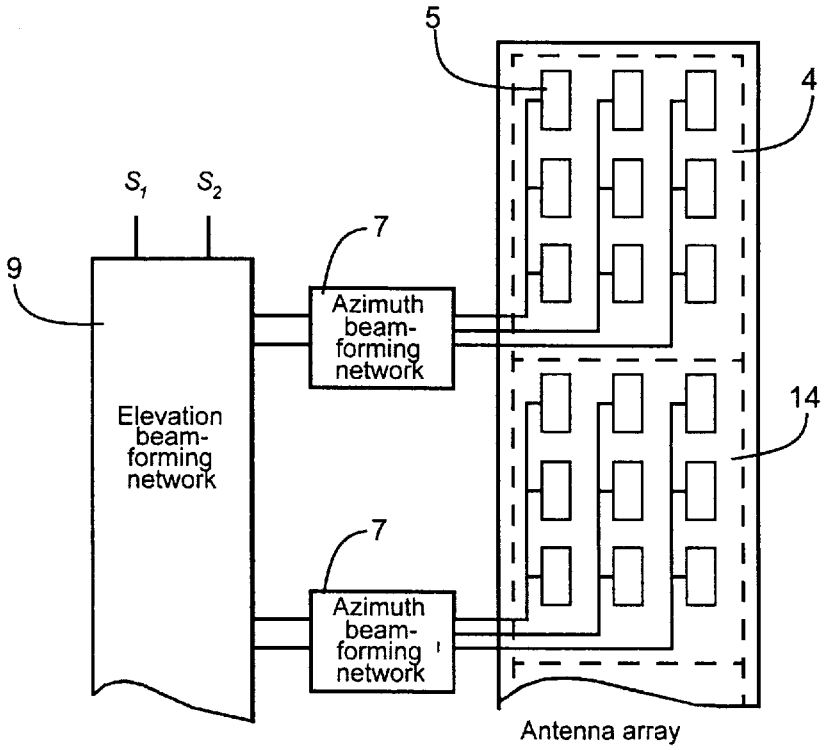
FIG. 8 is a block diagram of the dual-beam aperture unit having three columns of three-element azimuth arrays according to the present arrangement invention.

However, according to the invention an antenna is formed with aperture having three separate columns of element in the azimuth direction and an azimuth beam-forming network/section for shaping of the lobes as is indicated in FIG. 8. FIG. 7 illustrates such an illustrative embodiment having in each panel 3*a* and 3*b* three columns of seven vertically polarized patch radiators 5. However, as radiating elements other than patch elements may be used any other suitable available radiator elements and the polarization used may as well be arbitrary chosen. For instance, instead of the vertical polarization illustrated by the present embodiment a polarization plane of +45° or −45° may as well be chosen. The panels of the illustrative embodiment may further be divided into two sub-panels comprising in each vertical column four and three patch elements, respectively. As one possibility the upper sub-panel of 3×4 may for instance serve a radiation diagram of a higher elevation and the lower sub-panel 3×3 may serve a radiation diagram of a lower elevation. Of course the sub-panels of a panel may also form two common lobes in elevation and azimuth but still being fed by separate beam-forming networks. FIG. 8 illustrates the block diagram of a portion of a base-station antenna with two sub-panels of 3×3 in elevation shown. The antenna could be sectioned in an arbitrary number of elevation sub-panels. The antenna according to a preferred embodiment is vertically polarized and consists generally of about 2–8 sections in the elevation direction. Each section has three columns in the azimuth plane containing at least three aperture-coupled patch antenna elements 5 fed by a strip-line network for each column. The three element columns of FIG. 8 are connected to an azimuth beam-forming network 7 and each such network is additionally connected to an elevation beam-forming network 9. The elevation beam-forming network is not considered being part of the present invention and is therefore not further described. The $S_1$ and $S_2$ signals for creating the two azimuth lobes are attached to the input ports of the elevation beam-forming network, which provides the desired elevation diagram and tilt angle.

Sufficiently good side-lobe suppression is achieved by a three-element array. Unfortunately, the side-lobe levels of a two-element array are too high for practical applications. Designing a beam-forming network for three terminals constitutes a more complicated task. However, two such networks 7 could be accomplished by using 90° hybrid junctions or a combination of 90° hybrids and power splitters. In the first case illustrated in FIG. 9, using four hybrids 11, a fixed 90° phase-gradient is created between the signals appearing at the antenna ports. In the second case illustrated by FIG. 10 an arbitrary phase-gradient is created.

Beam-forming with 90° phase-gradient

Figure 9:
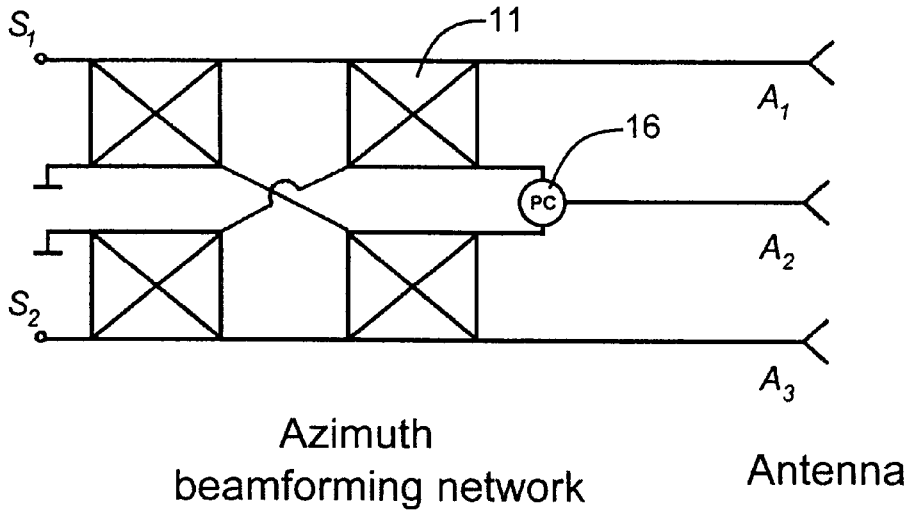
FIG. 9 illustrates an azimuth beam-forming circuit consisting of four hybrids.

An azimuth beam-forming network consisting of 4 hybrids is shown in FIG. 9. The network by using a power combiner 16 has three output terminals and two input ports $S_1$ and $S_2$. A 90° phase-gradient is created between the signals appearing at the antenna ports. The theoretical signals appearing at the antenna terminals $A_1$, $A_2$, and $A_3$ are shown in FIG. 19 as Table I. In the practical situation the amplitude and phase of the excitations will be altered due to the coupling between the antenna elements. A desired tapering by a factor 2 of the signal power are achieved as seen in the table. Thus, the excitation, i.e. the amplitude, of the middle element is about 41% larger than the excitation of the side-elements.

Beam-forming with arbitrary phase-gradient

Figure 10:
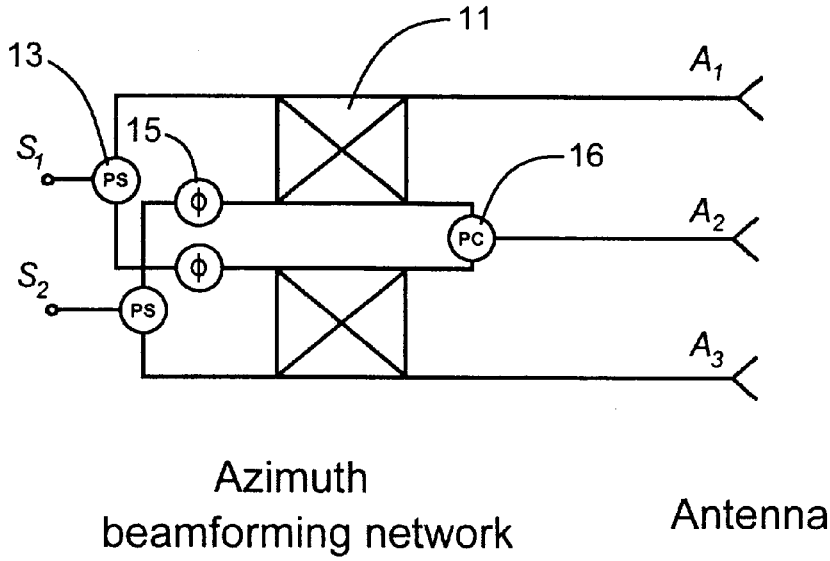
FIG. 10 illustrates an azimuth beam-forming circuit providing arbitrary phase-gradient angle.

Azimuth beam-forming with arbitrary phase-gradient is demonstrated in FIG. 10. The network consists of two hybrids 11, two power splitters 13, two phase-shifters 13 and a power combiner 16. An arbitrary phase-gradient is created between the signals appearing at the antenna ports by varying the angle of the phase-shifters $\phi$. Some theoretical excitations appearing at the antenna terminals $A_1$, $A_2$, and $A_3$ are shown in FIG. 20 as Table II. In practice the amplitude and phase of the excitations will be altered due to the coupling between the antenna elements as in the previous case.

Applications

Figure 11:
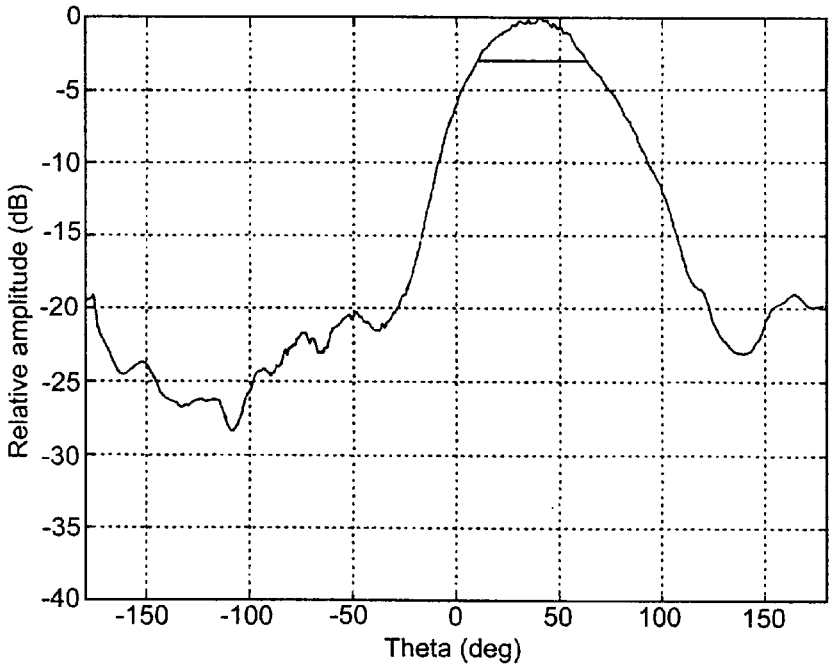
FIG. 11 shows an azimuth antenna diagram for one of the beams of the three-element dual-beam aperture with 90° phase-gradient angle.
Figure 12:
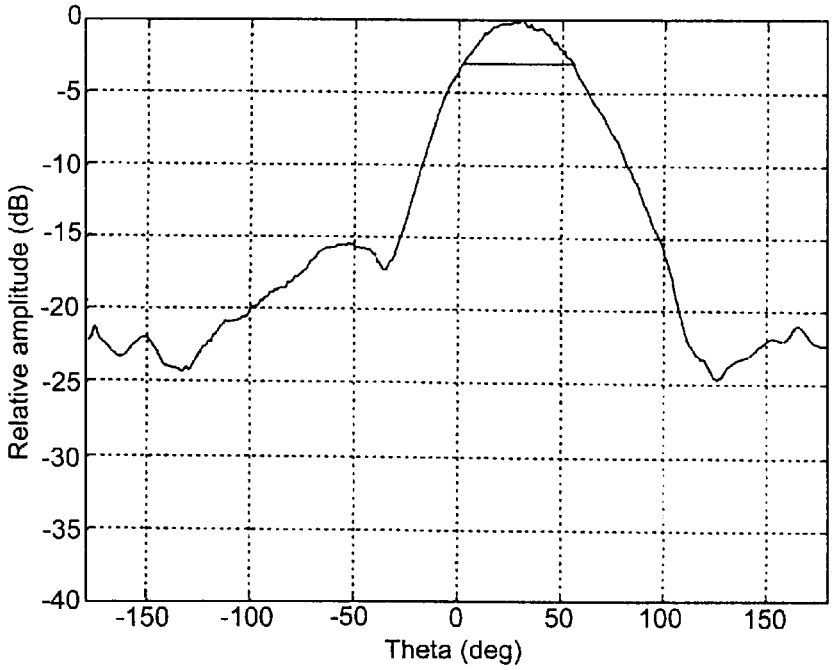
FIG. 12 shows an azimuth antenna diagram for one of the beams of the three-element dual-beam aperture with the angle of the phase-shifters $\phi=65°$.
Figure 13:
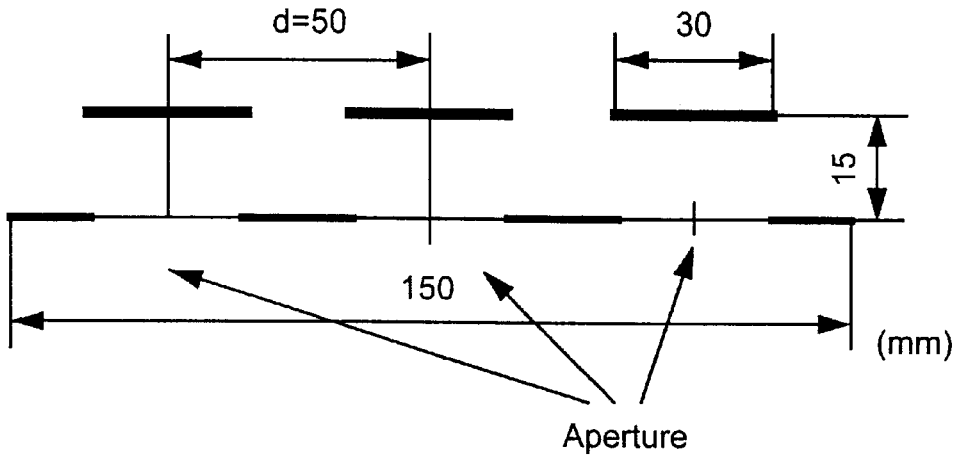
FIG. 13 shows the geometry of the dual-beam aperture each consisting of three columns having 3 aperture-fed patch elements for a frequency of 2045 MHz.

The azimuth antenna patterns of the three-element array were measured on a 4×3 element model. The resulting diagram was simulated using excitations of the two different azimuth beam-forming networks, including effects of the feeding network and coupling. FIG. 11 illustrates the measured diagram for the three-element dual-beam aperture at a frequency of, 30 mm wide elements at a distance d of 50 mm as illustrated by FIG. 13. Beamwidth=55 degrees and scan angle=37 degrees. It can be seen that in the orthogonal case of FIG. 9 with a scan angle of 37 degrees the side lobe level is down to almost −20 dB. FIG. 12 illustrates the measured diagram for the three-element dual-beam aperture with phase-gradient <90° and $\phi$=65° at a frequency of 2045 MHz 30 mm wide elements at a distance of 50 mm. Beam-width= 55 degrees and scan angle=29 degrees. In this case when no longer orthogonal signal between the three terminals the side lobe level is slightly deteriorated to the order −15 dB as worst, but still presenting an acceptable value. The dimensions of the antenna section refer as before to FIG. 13. The resulting scan angles and beam- widths are presented in FIG. 21 as Table III.

The fixed azimuth beam-forming network (network of FIG. 9) gives 37° scan angle and 55° beam-width compared to the desired values of 30° scan angle and 60° beam-width. However, it is possible to get close to the desired scan angle by using the network of FIG. 10 as can be seen in Table III Using the adjustable network gives 29° scan angle and 53° beam-width.

Figure 14:
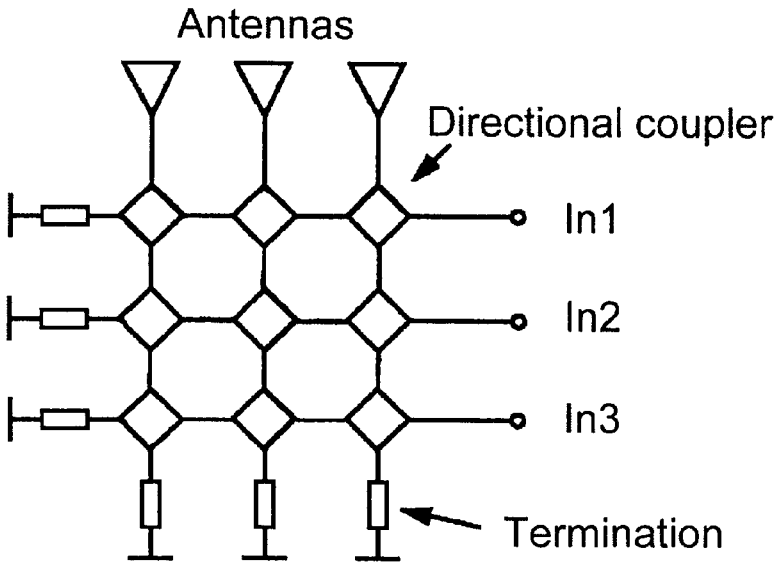
FIG. 14 illustrates a Blass matrix consisting of three antennas and three input ports.

An azimuth beam-forming network can be implemented as a Blass matrix by using six directional couplers. Such a Blass matrix with three ports is illustrated in FIG. 14. The Blass matrix allows the number of input ports to be less than the number of antenna elements. The input ports are placed at the right side of the matrix (In1 and In2 in FIG. 1), and the antenna ports at the top of the matrix. The remaining connections are terminated with matched loads. Two beams are formed by connecting signals to the In 1 and In 2 ports. The drawback with the Blass matrix network is that a substantial amount of the input power is lost in the terminations.

Figure 15:
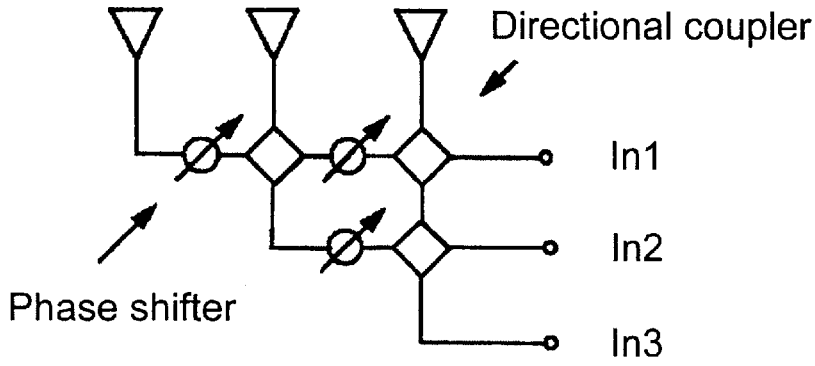
FIG. 15 illustrates a Nolan matrix with three antenna elements and three ports.
Figure 16:
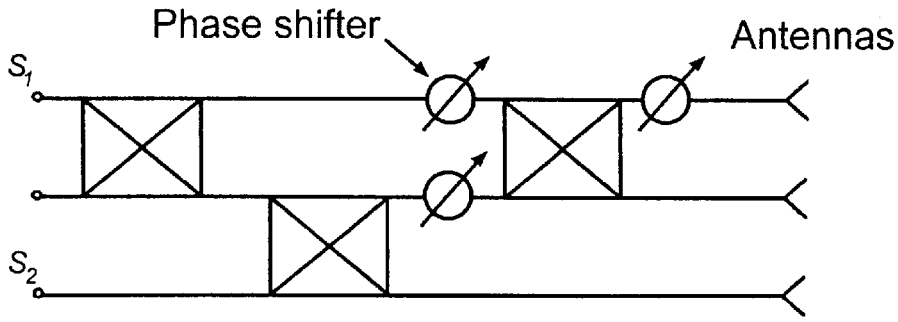
FIG. 16 illustrates a network for three antennas comprising phase-shifters and three ports.

Still another alternative for driving the three radiating columns of patch elements would be a Nolan matrix presenting three ports indicated in FIG. 15. Such a Nolan matrix will be identical with the equivalent circuitry of FIG. 16 showing a network with three antennas and three ports. The Nolan-type azimuth beam-forming network consists of three directional couplers and three phase-shifters. The input signal is attached to two of the input ports (In 1, In 2 or In 3) while the remaining port is terminated. The directional couplers could have arbitrary coupling and directivity depending on which beam parameters that are desired. The drawback with the tree port Nolan network is that it is not symmetric and will not generate symmetric beams.

Figure 17:
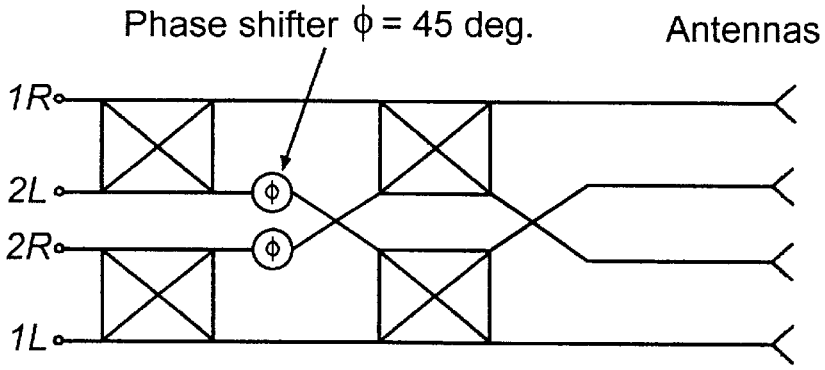
FIG. 17 illustrates a general Butler matrix with N=4.

Finally still another alternative for the beam-forming network related to the first presented network (FIG. 9) is shown in FIG. 17. A N=4 Butler matrix consists of four directional couplers/hybrids and two phase-shifters $\phi$=45°. An azimuth beam-forming network for three antenna elements is achieved by combining two of the output ports of the Butler matrix. The input signals of the two beams are connected to one pair of the input ports (1R/1L or 2R/2L) while the remaining input ports are terminated with matched loads. The phase shift $\phi$ could be an arbitrary parameter or selected $\phi$=45° as in the FIG. 17.

A person skilled in the art will realize that where hybrids are referred to in the present description also directional couplers may instead be used.

Figure 2:
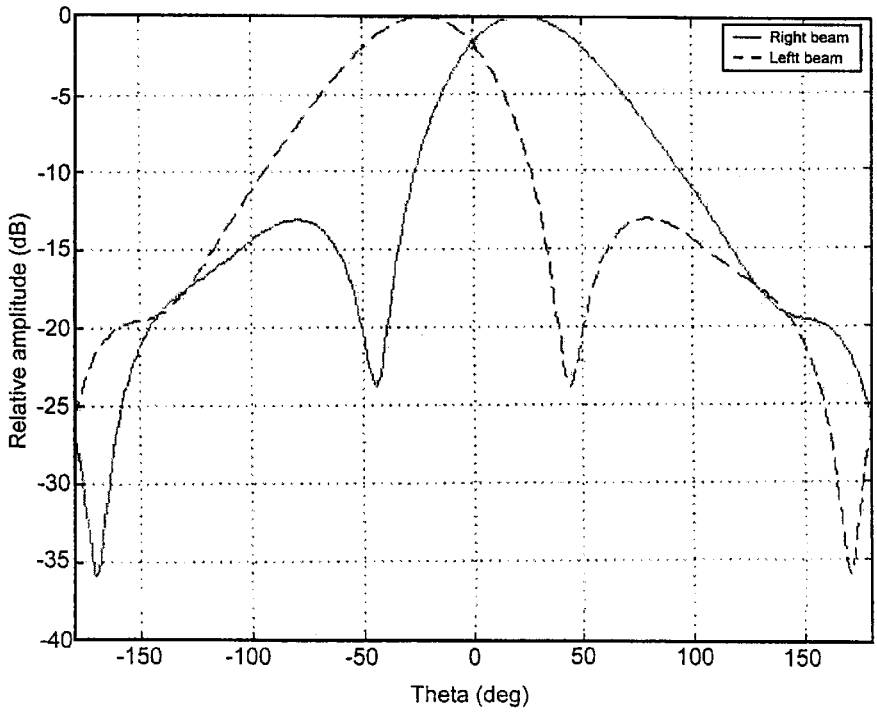
PRIOR ART Fig. 2
FIG. 2 illustrates a simulated azimuth antenna diagram of a dual-beam aperture consisting of a two-element array with 90° phase-gradient.
Figure 3:
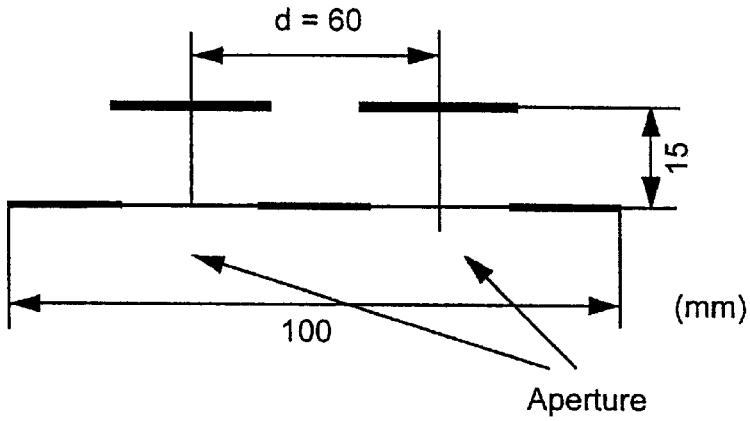
PRIOR ART Fig. 3
FIG. 3 demonstrates the geometry of a dual-beam aperture of a two-element array of aperture-fed patch antenna elements for a frequency of 2045 MHz.
Figure 18:
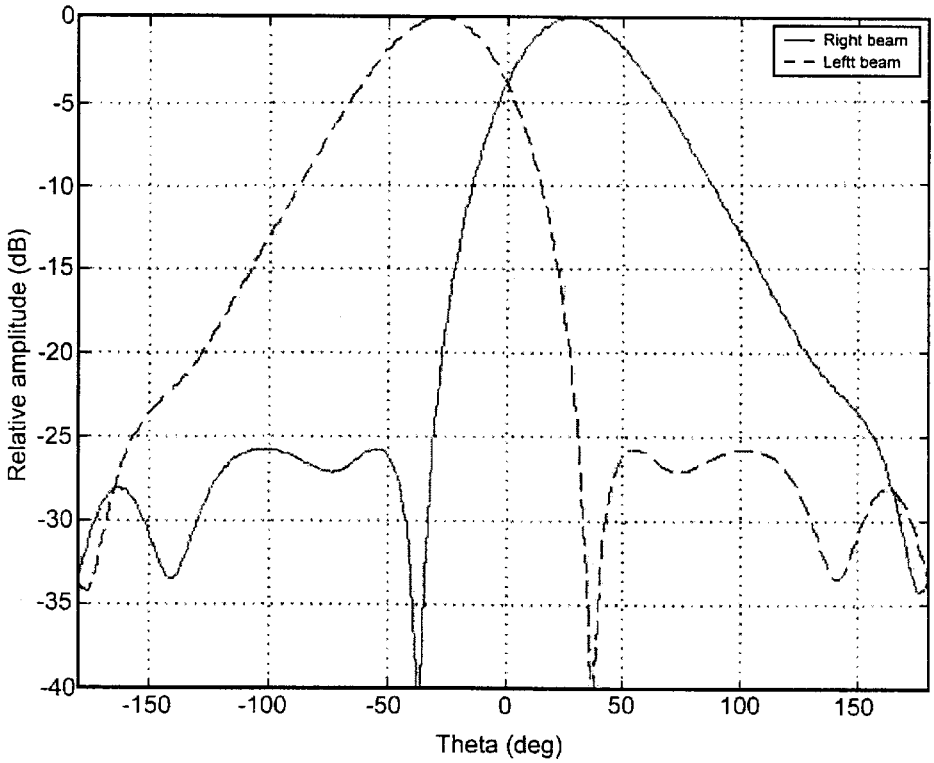
FIG. 18 illustrates a simulated azimuth antenna diagram for the dual-beam antenna aperture with three radiating elements.

In FIG. 18 is finally presented a simulated azimuth antenna diagram for the dual-beam antenna aperture at a frequency of 2045 MHz with three radiating element columns in accordance with the present invention. As can be seen a right beam has a null coinciding with the maximum of the left beam and vice versa. The side lobe level at the left and right of the respective right and left lobes is well below −25 dB. This is to be compared to the diagram in FIG. 2 illustrating the state of the art.

It will be understood by those skilled in the art that various modifications and changes may be made to the present invention without departure from the scope thereof, which is defined by the appended claims.

What is claimed is:

1. An antenna arrangement having an aperture generating a multi-beam pattern with lower side-lobe levels for a base station in a communications network, comprising:

a plurality of radiator elements arranged in three separate columns of elements along an antenna panel thereby forming an aperture; a number of such panels forming a base station antenna, each such aperture producing two beams;

each group of three separate columns forms at least one sub-panel for a different elevation pattern; and each sub-panel of three columns is connected to a beam-forming network having a first, a second and a third output terminal forming antenna ports and two input terminals and creating a phase-gradient between signals appearing at the antenna ports.

2. The antenna arrangement according to claim 1, wherein said three separate columns are vertically polarized and include at least two sections in an elevation direction.

3. The antenna arrangement according to claim 2, wherein each one of the three columns has at least three radiator elements.

4. The antenna arrangement according to claim 3, wherein said radiator elements consist of patch antenna elements separately fed by a strip-line network.

5. The antenna arrangement according to claim 1, wherein two such panels are arranged to form an antenna device covering a wide sector up to 240 degrees in an azimuth plane.

6. The antenna arrangement according to claim 1, wherein that said beam-forming network for each panel contains four hybrids and a power combiner producing two beams of approximately 60° pointing about ±30° off the aperture normal.

7. The antenna arrangement according to claim 6, wherein said beam-forming network provides a tapered signal at a first and a third output terminal forming signal ports to the radiator elements of a column, for obtaining an excitation of a second middle radiator element column being larger than the excitation of the columns to either side of said middle column.

8. The antenna arrangement according to claim 1, wherein said beam-forming network for each panel contains two hybrids, two power splitters, two phase-shifters and a power combiner producing two beams with arbitrary phase-gradients.

9. The antenna arrangement according to claim 8, wherein said beam-forming network provides a tapered signal at a first and a third output terminal forming signal ports to the radiator elements of a column, for obtaining an excitation of a second middle radiator element column being larger than the excitation of the columns to either side of said middle column.

10. The antenna arrangement according to claim 8, wherein said beam-forming network produces two beams of approximately 60° pointing about ±30° off the aperture normal as obtained by means of the phase-shifters.

11. The antenna arrangement according to claim 10, wherein said beam-forming network provides a tapered signal at a first and a third output terminal forming signal ports to the radiator elements of a column, for obtaining an excitation of a second middle radiator element column being larger than the excitation of the columns to either side of said middle column.

12. The antenna arrangement according to claim 1, wherein said beam-forming network comprises a 3×3-port Blass matrix having one of its input ports terminated.

13. The antenna arrangement according to claim 1, wherein said beam-forming network utilizes a 3×3-port Nolan matrix having one of the input ports terminated.

14. The antenna arrangement according to claim 1, wherein said beam-forming network utilizes a 4×4-port Butler matrix having two input ports terminated and two antenna output ports combined.

15. The antenna arrangement according to claim 1, wherein said three separate columns are vertically polarized and include between 2 and 8 sections in an elevation direction.

16. An antenna system forming a multi-lobe arrangement with lower side-lobe levels for base stations in communication networks, comprising:

panels forming antenna apertures provided with three vertical columns of radiator elements, the three vertical columns of radiator elements being fed by an azimuth beam-forming network to have each panel forming a dual-beam aperture showing improved side-lobe levels, and two such panels forming an angled common panel providing an antenna arrangement covering a sector of the order up to 240 degrees in an azimuth plane.

17. The antenna system according to claim 16, wherein each panel having three columns of radiators is divided into a number of sub-panels, each sub-panel also presenting three vertical columns of radiators fed by a separate azimuth beam-forming network which in turn is fed by an elevation beam-forming network.

18. The antenna system according to claim 16, wherein said radiator elements constitute vertically polarized patch elements fed by a strip-line network.

19. The antenna system according to claim 16, wherein three pairs of panels form an antenna arrangement covering 360°, thereby further simplifying a mechanical structure of a base station antenna array and reducing its wind-load.

20. The antenna system according to claim 16, wherein said beam forming network constitutes any of a Blass matrix, a Nolan matrix or a Butler matrix.

21. The antenna system according to claim 20, wherein said beam-forming network operates with a 90° phase-gradient.

22. The antenna system according to claim 20, wherein said beam-forming network operates with an arbitrary phase-gradient.

* * * * *